US010294057B2

(12) United States Patent
Devitt et al.

(10) Patent No.: US 10,294,057 B2
(45) Date of Patent: May 21, 2019

(54) GAS BEARING, POROUS MEDIA VACUUM ROLLER AND POROUS MEDIA AIR TURN

(71) Applicant: NEW WAY MACHINE COMPONENTS, INC., Aston, PA (US)

(72) Inventors: Andrew J. Devitt, Media, PA (US); Richard Duane Pollick, West Chester, PA (US)

(73) Assignee: NEW WAY MACHINE COMPONENTS, INC., Aston, PA (US)

( * ) Notice: Subject to any disclaimer, the term of this patent is extended or adjusted under 35 U.S.C. 154(b) by 154 days.

(21) Appl. No.: 14/847,895

(22) Filed: Sep. 8, 2015

(65) Prior Publication Data

US 2016/0068360 A1 Mar. 10, 2016

Related U.S. Application Data

(60) Provisional application No. 62/113,169, filed on Feb. 6, 2015, provisional application No. 62/046,870, filed on Sep. 5, 2014.

(51) Int. Cl.
*B65H 27/00* (2006.01)
*B65H 23/32* (2006.01)

(52) U.S. Cl.
CPC ..... *B65H 27/00* (2013.01); *B65H 23/32* (2013.01); *B65H 2406/111* (2013.01);
(Continued)

(58) Field of Classification Search
CPC ..... B65H 20/14; B65H 2404/1362; B65H 2404/1363; B65H 27/00; B65H 23/32;
(Continued)

(56) References Cited

U.S. PATENT DOCUMENTS 3,122,295 A 2/1964 Davison et al.
4,176,775 A 12/1979 Brendemuehl
(Continued)

FOREIGN PATENT DOCUMENTS

CA 2798032 A1 12/2011
JP 62192540 A 8/1987
(Continued)

*Primary Examiner* — Michael C McCullough
(74) *Attorney, Agent, or Firm* — Volpe and Koenig, P.C.

(57) ABSTRACT

In order to provide web handling which mitigates marking of the web, externally-pressurized porous media gas bearings are used for vacuum rollers, which provide differential tension, and also for air turns, which provide non-contact turning of webs. The porous media gas bearings mitigate three of the biggest issues with the current technology, including cost, high flow rates and low pressure, and web marking. By introducing positive pressure or both, various configurations are presented which allow for improved differential tension, or non-contact conveyance. By also employing externally-pressurized radial bearings, more alternatives are provided, including conveyance and lateral motion of webs without the use of motors. Lastly, employing novel lightweight materials allows for yet other configurations which also employ some of the same aforementioned benefits.

14 Claims, 15 Drawing Sheets

(52) U.S. Cl.
CPC ..... *B65H 2406/14* (2013.01); *B65H 2406/15* (2013.01); *B65H 2406/33* (2013.01)

(58) Field of Classification Search
CPC ..... B65H 2406/111; B65H 2406/1115; B65H 2406/115; B65H 2406/33
See application file for complete search history.

(56) References Cited

U.S. PATENT DOCUMENTS

| | | | | |
|---|---|---|---|---|
| 4,207,998 | A | 6/1980 | Schmid | |
| 4,277,010 | A | 7/1981 | Landsckroener et al. | |
| 4,998,658 | A | 3/1991 | Distefano et al. | |
| 5,423,468 | A * | 6/1995 | Liedtke ..... | B65H 23/24 242/615.12 |
| 6,641,513 | B1 | 11/2003 | Ward et al. | |
| 6,983,692 | B2 * | 1/2006 | Beauchamp et al. ... | B41F 21/10 101/409 |
| 7,025,303 | B2 * | 4/2006 | Meyer ..... | B29C 47/0026 226/97.3 |
| 7,654,427 | B1 | 2/2010 | Tsai et al. | |
| 7,708,176 | B2 | 5/2010 | Chuang et al. | |
| 8,931,675 | B2 | 1/2015 | Bentchev et al. | |
| 2004/0007318 | A1 | 1/2004 | Popp et al. | |
| 2006/0261120 | A1 | 11/2006 | Slyne | |
| 2013/0200127 | A1 | 8/2013 | Bentchev et al. | |

FOREIGN PATENT DOCUMENTS

| | | | |
|---|---|---|---|
| JP | 63277163 | A | 11/1988 |
| JP | 2004026348 | A | 1/2004 |
| JP | 2005013968 | A | 1/2005 |
| WO | 2011152430 | A1 | 12/2011 |
| WO | 2012102398 | A1 | 8/2012 |

* cited by examiner

GAS BEARING, POROUS MEDIA VACUUM ROLLER AND POROUS MEDIA AIR TURN

REFERENCE TO RELATED APPLICATIONS

This application claims the benefit of U.S. Provisional Application Nos. 62/113,169, filed Feb. 6, 2015; and 62/046,870, filed Sep. 5, 2014, whose disclosures are hereby incorporated by reference in their entireties into the present disclosure.

FIELD OF INVENTION

This application is generally related to vacuum rollers and non-contact air turns used in web handling applications for thin film flexible membranes, such as plastics, vinyl, glass, foil, or other materials, that are employed in production machinery and systems for making the same.

BACKGROUND

Vacuum rollers and air turn bars (hereinafter "air turns") are used in web handling applications to create differential tension on either side of the roller (tension isolation), to only allow contact on one side of the web (as opposed to pinch rollers which contact both sides), and to reverse the direction of the web flow, respectively. State-of-the-art vacuum rollers and air turns may possess certain features and characteristics which drive up cost and negatively affect quality.

In the case of common vacuum rollers, tension isolation is accomplished using an inner stationary member which comprises the desired wrap angle. Vacuum is generated within an inner stationary member via a vacuum pump, and when a rotating outer roller passes over the wrap angle portion, vacuum is conducted through a series of holes in the surface of the outer roller, and thus generates the desired friction over the wrap angle. For current art designs, the inner member and the outer roller must have very precise mating surfaces so that vacuum pressure does not escape. Three of the biggest issues with the current technology is that: (1) it is very expensive due to the elaborate design and precision components required, (2) the vacuum flow rate is high, and the vacuum pressure is low, and (3) the web may be marked by the holes in the outer rotating roller.

Common turn rollers are used in web handling to change the direction of the web as it progresses through its course. State-of-the-art air turns employ the use of pressurized air to lift a web off of the surface of the roll. These are typically manufactured from metal components by creating an arc through which air is passed through a series of channels, utilizing a variety of configurations, such as provided by Advance Systems, Inc. (ASI). These systems, due to the amount of escaping air, typically have high flow rates. Also, as in the case of vacuum rollers, the web may be marked by the air passageways over which the web passes, in the event of contact.

SUMMARY

Embodiments disclosure may utilize a porous material which is externally pressurized, with positive or negative gas pressure, to effect a key function of a gas bearing, porous media vacuum roller or air turn.

In the case of a vacuum roller, the porous media which covers the outside surface of the roller, or partial arc roller, may allow for a web to be vacuumed uniformly to the porous media surface to create differential tension over a desired wrap angle, or the porous media on the exterior of the roller may be used in conjunction with a porous radial bearing to produce a desired net force that acts upon the web.

In the case of an air turn, the porous media covers the outside surface of the roller, or partial arc roller, and may allow for a web to traverse over the roller in a non-contact fashion, without the need for the roller to rotate.

The subject invention solves several key issues contained in the current art: (1) it is a relatively simple (and cost effective) design, because it mitigates the need for highly precise machined surfaces, (2) the vacuum flow rate is relatively low (for example 1 to 10 scfm), and the vacuum pressure can be at least as high as the state-of-the-art technology, and (3) porous media has microscopic sized holes, thus mitigating concerns stemming from the web being marked by the edges of the holes in the roller.

BRIEF DESCRIPTION OF THE DRAWINGS

The foregoing summary, as well as the following detailed description of the preferred embodiments, will be better understood when read in conjunction with the appended drawings. For the purpose of illustrating embodiments of the invention, there is shown in the drawings example embodiments. It should be understood, however, that the invention is not limited to the precise arrangements shown.

DETAILED DESCRIPTION OF THE PREFERRED EMBODIMENTS

Figure 1A:
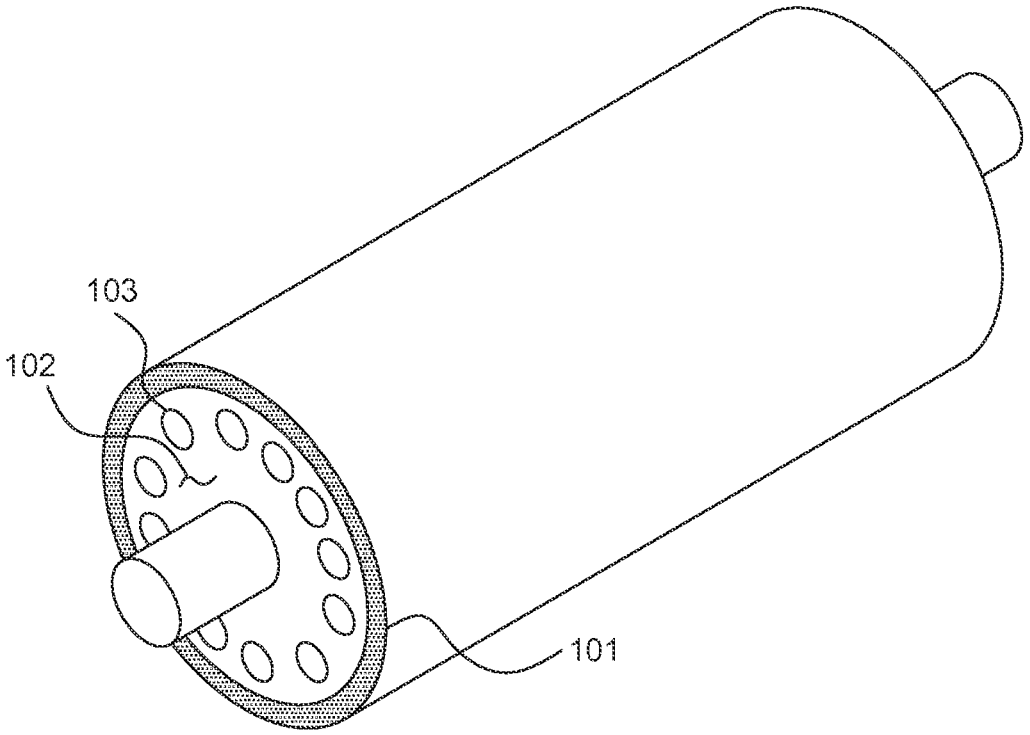
FIG. 1A shows an example of a porous media vacuum roller.

Certain terminology is used in the following description for convenience only and is not limiting. The words "front," "back," "left," "right," "inner," "outer," "upper," "lower," "top," and "bottom" designate directions in the drawings to which reference is made. Additionally, the terms "a" and "one" are defined as including one or more of the referenced item unless specifically noted otherwise. A reference to a list of items that are cited as "at least one of a, b, or c" (where a, b, and c represent the items being listed) means any single one of the items a, b, or c, or combinations thereof. The terminology includes the words specifically noted above, derivatives thereof, and words of similar import.

Figure 1B:
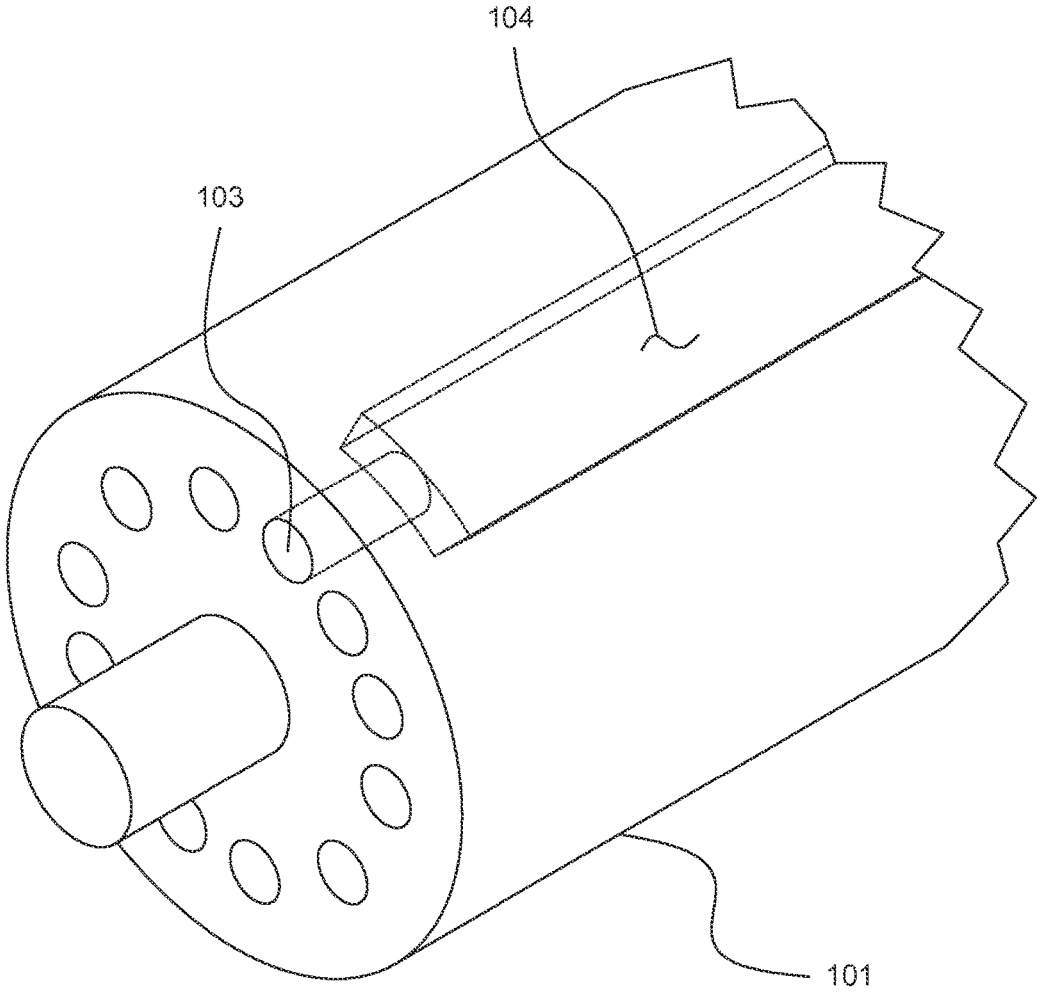
FIG. 1B shows an example of a porous media vacuum roller shaft.

As illustrated in FIGS. 1A and 1B, a solid or hollow rotatable shaft 101 manufactured out of metal or some other suitable material may contain axial holes 103 which are connected to grooves 104 contained in the shaft 101 or machined into an outer porous media sleeve 102. The sleeve 102 may be installed and glued on the outside of the shaft 101. The holes 103 may be on one or both sides of the shaft, or on one or both sides of the outer porous media sleeve 102. The outer porous media sleeve may be one continuous member or may be attached to the shaft in segments, so long as the segments are sealed together to prevent escapement of gas.

Figure 1C:
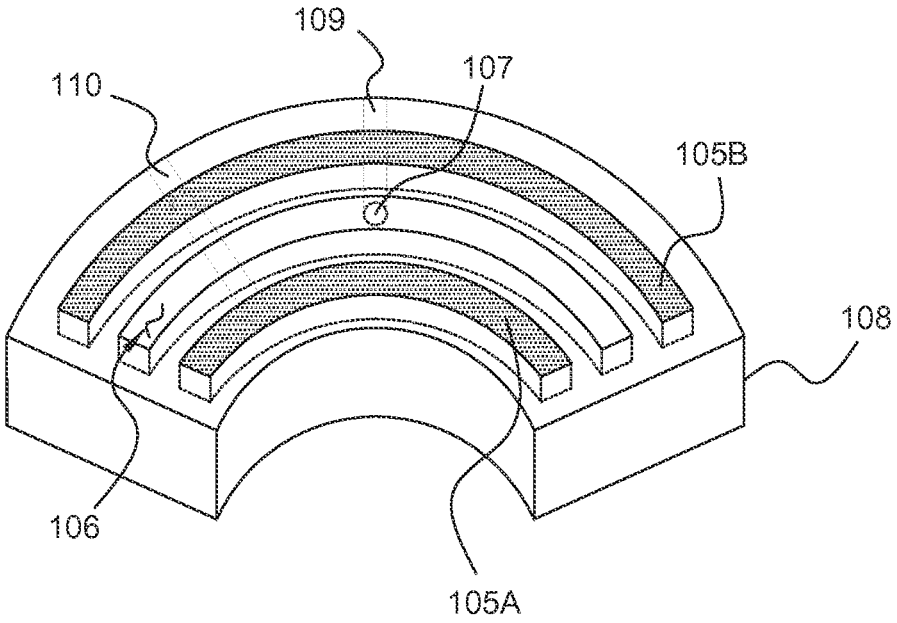
FIG. 1C shows an example of a porous media vacuum roller partial wrap end plate.
Figure 1D:
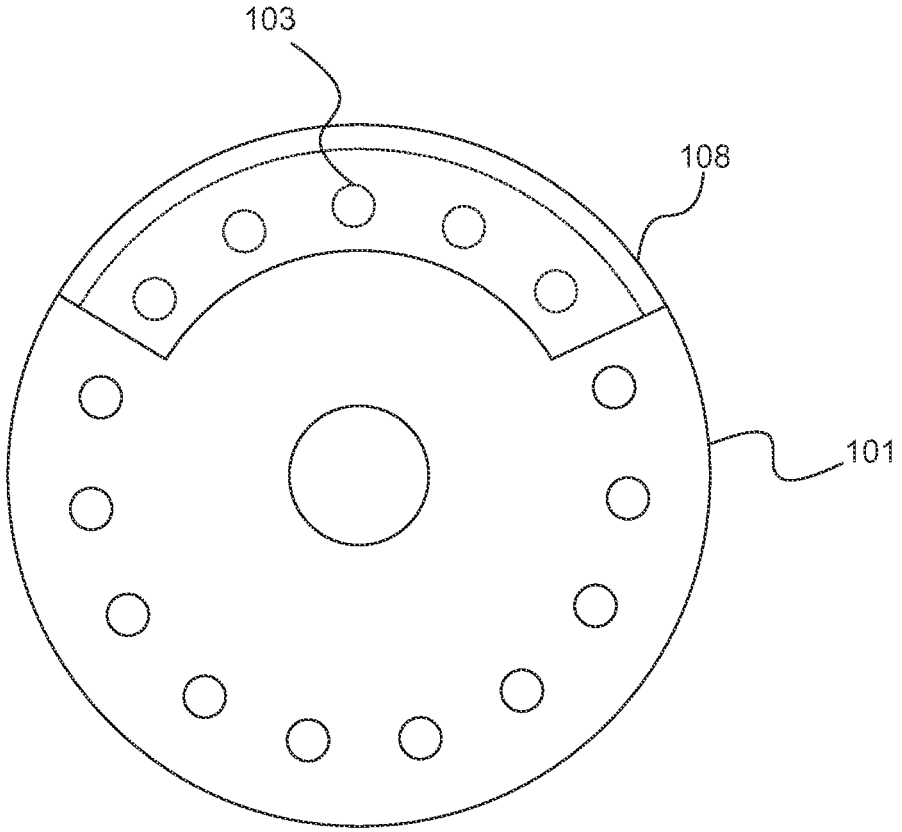
FIG. 1D shows an end view of an example porous media vacuum roller shaft and with partial wrap end plate.

FIGS. 1C and 1D show an example end plate 108 which is attached to one or both ends of the shaft 101 by any mechanical means common in the art. A metal holder 108 houses porous material 105A and 105B. The porous material 105 contains a slotted region 106 through which a vacuum is pulled via holes 107. Vacuum is introduced into the end plate via port 109, which conducts vacuum pressure to a hole 107 via passageways contained in the holder 108 or porous media 105A or 105B. In this depiction, the faces of the porous media 105A or 105B and the holder 108 are all in the same plane. Operation of the subject vacuum roller is accomplished by introducing vacuum pressure into port 109. The vacuum is distributed through a hole 107, and then into groove 106. Concurrently, positive gas pressure is introduced into port 110, and creates a pressurized gap that acts as a bearing between the face of the porous media 105 and the end face of the shaft 101. The shaft will also need to be borne by a bushing (not shown) to carry the radial load imparted by the shaft's weight and the loading resulting from web tension acting on the shaft. It is noted that such a bushing may also be a gas bushing as commonly provided by New Way Air Bearings, or the bushing may be integrated with the end plate shown in FIG. 1D in the form of a thrust bushing as commonly provided by New Way Air Bearings.

Further, the end plate of FIG. 1D remains stationary as the shaft 101 rotates. As the shaft 101 rotates 111, holes 103 corresponding to the arc angle defined by the wrap angle of the end plate will receive vacuum that is conducted by such mating holes 103. The vacuum acts upon the same given arc angle as the shaft 101 rotates, thus providing vacuum in a desired sector of the shaft 101. As vacuum is applied only to the desired arc length of the shaft 101, the traversing web is held to the shaft 101 only in that region, and differential tension is able to be generated on either side of the wrap angle. As the shaft 101 continues to rotate out of the wrap angle sector, vacuum pressure is no longer present, and the web does not adhere to the roll in the region outside of the desired wrap angle.

In an embodiment, differential tension is provided on either side of the wrap angle. This feature mitigates the need for highly machined surfaces, enables a vacuum flow rate that is relatively low (for example 1 to 10 scfm), and a vacuum pressure that may be at least as high as state-of-the-art technology, but with a lower flow rate. This is accomplished by the fact that the proven nature of gas bearings is such that the gaps between the end face and rotor face are extremely small, and such gaps require a very low gas flow rate and produce high pressures (or vacuums) which are very efficient. It should also be noted that since porous media has microscopic sized holes, the outer porous media sleeve member 102 mitigate issues related to the web being marked by the edges of holes present in the prior art.

Figure 1E:
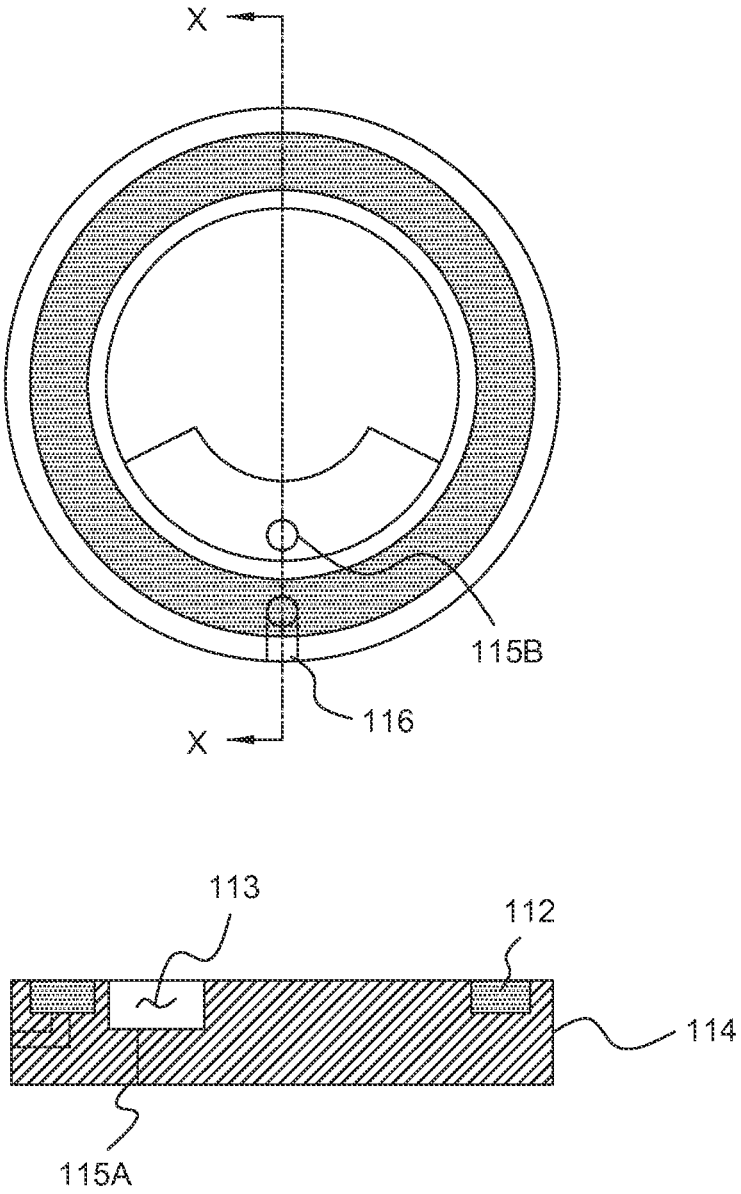
FIG. 1E shows an example of an alternative porous media vacuum roller end plate.

An alternative end face is shown in FIG. 1E. This depiction is very similar to a vacuum preloaded (VPL) gas bearing provided by New Way Air Bearings, except for the fact that the faces of the porous media 112 and the holder 114 are all in the same plane. Another difference with common VPL type bearings is the fact that the vacuum groove 113 is only a partial arc, corresponding to the desired wrap angle of the web. A vacuum port 115A leads to a vacuum hole 115B which creates vacuum in the groove 113. A pressure port 116 leads to the porous media 112 to create a gas bearing functionality at the face of the porous media.

Figure 1F:
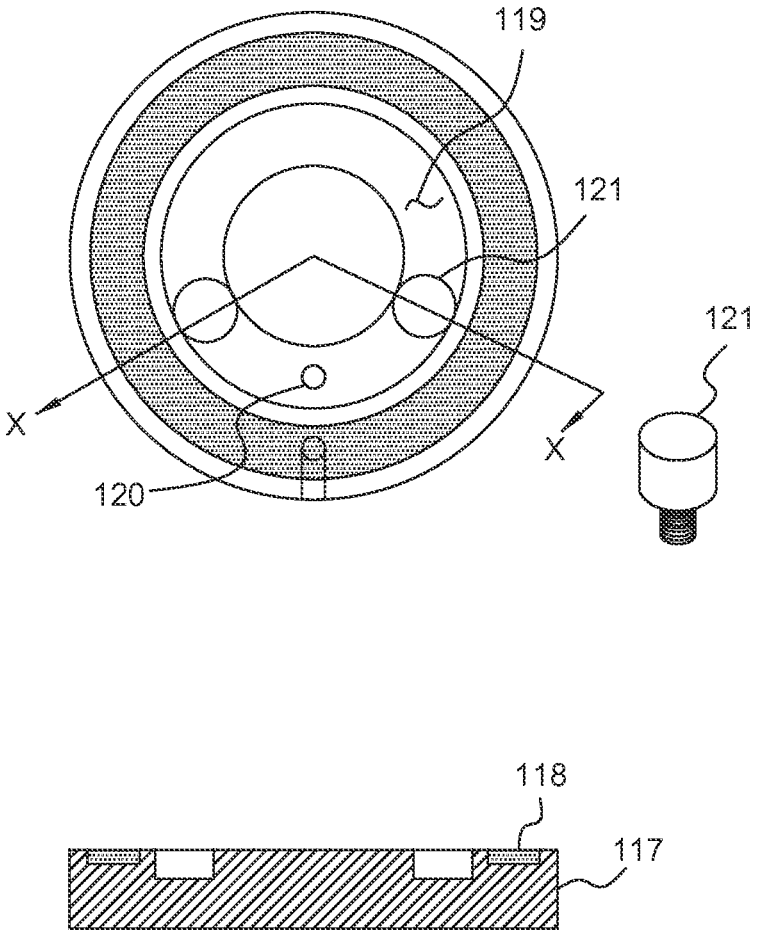
FIG. 1F shows an example of a porous media vacuum roller end plate having flexible wrap angle capability.

Another example end face is shown in FIG. 1F. In this case, the holder 117 contains porous media 118; however, this depiction is different than FIG. 1E in that groove 119 is a full 360 degrees, and there is a vacuum hole 120 leading into the vacuum groove 119. Furthermore, close fitting groove fillers 121 are installed in the groove 119 at a desired wrap angle. The groove fillers 121 allow for setting a flexible wrap angle without the need for a new or modified end plate. Depending on the desired wrap angle, one of the multiple vacuum ports is used to conduct vacuum pressure to the groove sector which has been set. The groove fillers 121 are contained in the groove 119 by any mechanical means common in the art, such as threading, as shown. It is not necessary that the groove fillers 121 create a 100 percent air tight vacuum groove to allow for proper functionality. The groove fillers may be other shapes than cylindrical.

Another embodiment for creating a vacuum roller using porous media technology is shown in FIGS. 2A through 2D. FIGS. 2A through 2D show a rotatable solid shaft 201 with a porous media sleeve 202 installed and glued over the outside. Vacuum pressure from a vacuum pump or equivalent is pulled through port 203 and is conducted through one or a plurality of plenums 204, which in turn creates vacuum pressure on the entire porous media sleeve 202. This vacuum pressure draws gas from the atmosphere outside of the roller, and it is conducted through the porous media 202 into the plurality of plenums 204, and is conducted out of the port 203. As the shaft 201 rotates, the traversing web 205 is acted upon with vacuum over the desired wrap angle 206. One portion of the web can be kept taut and the other portion can be slack; hence, differential tension is created by the porous media vacuum roller. The remaining portion 207 of the porous media over which the web does not traverse 202 will also have vacuum pulled on this surface, and this vacuum is effectively not used for the function of creating differential tension. Nevertheless, despite this "unused" vacuum the roll is still quite efficient at creating the desired differential tension due to its low flow and high vacuum capability.

Figure 2A:
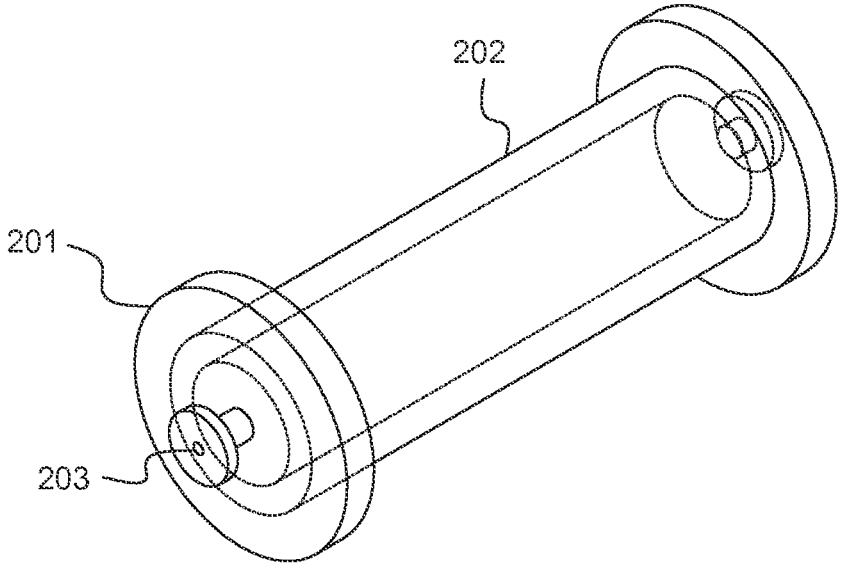
FIG. 2A shows an example of a porous media roller with a solid shaft and that can serve as a vacuum roller or air turn.
Figure 2B:
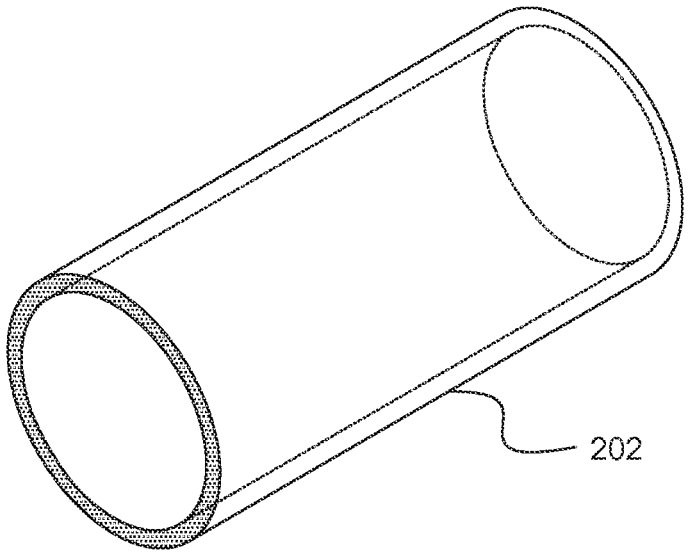
FIG. 2B shows an example of a one-piece outer porous media sleeve.
Figure 2C:
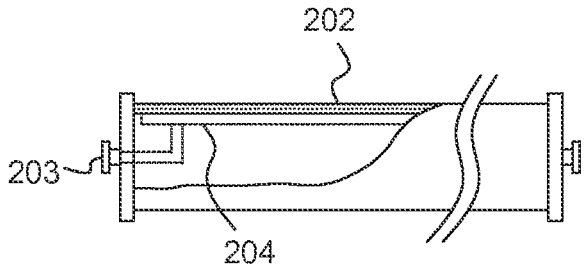
FIG. 2C shows an example of a porous media roller including gas conductance passageways.
Figure 2D:
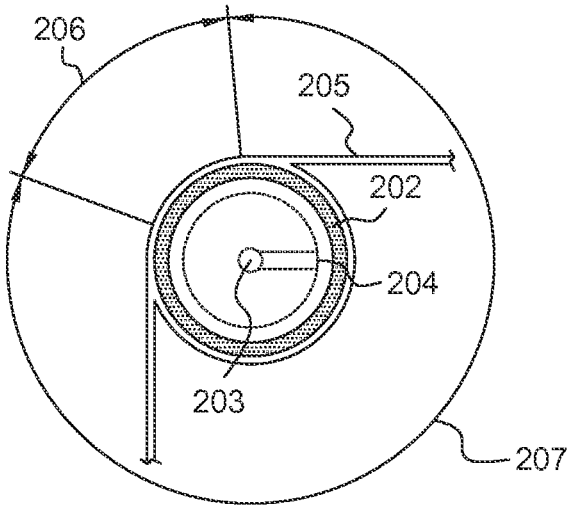
FIG. 2D shows an example of a porous media roller acting as a vacuum roller
Figure 2E:
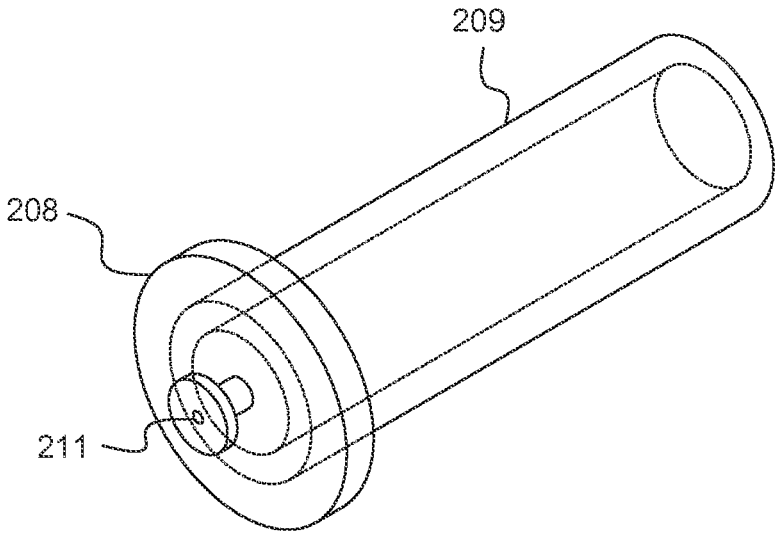
FIG. 2E shows an example of a porous media roller with a hollow shaft that can serve as a vacuum roller or air turn.

FIG. 2E shows an alternative to using a solid shaft as in FIG. 2A, while employing the same functionality as described for a solid shaft. In FIG. 2E, a hollow shaft 209 is coupled to a round end plate 208, which is attached to a journal 210. A porous media sleeve (not shown, but similar to that in FIG. 2A) can be installed and glued to the outside of the hollow shaft 209. A port 211 is installed into the journal.

Figure 2F:
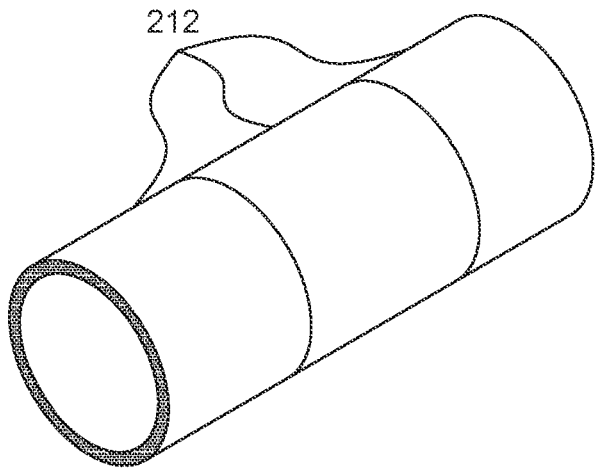
FIG. 2F shows an example of a multiple-piece outer porous media sleeve.

FIG. 2F shows an alternative to a solid porous media sleeve. Multiple porous media sleeve members 212 can be combined together and installed and glued onto a shaft.

Figure 2G:
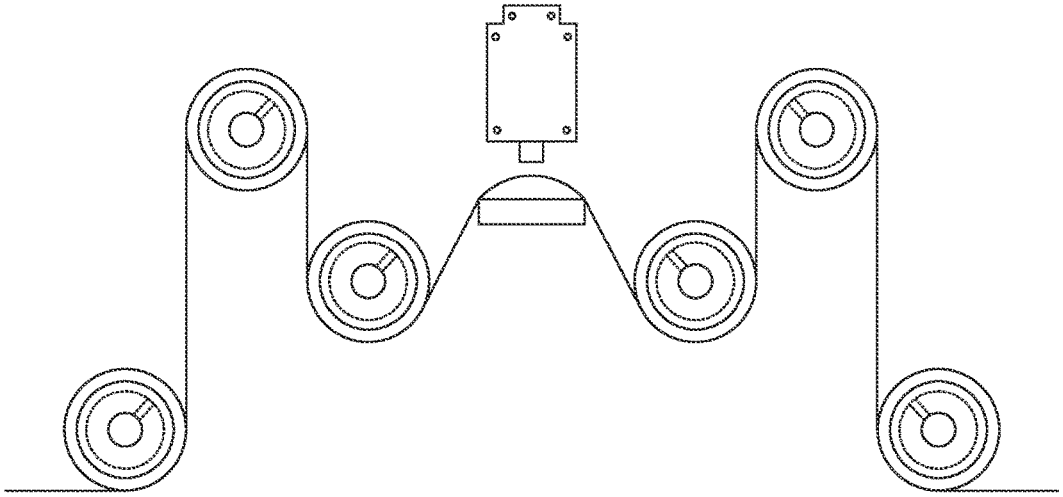
FIG. 2G shows an example of an arrangement of air turns in a production line.

It is important to note the universality of using the porous media to conduct vacuum or positive pressure in the context of the present described embodiments. For example, in the embodiments of FIGS. 2A through 2F, it is possible to substitute positive pressure in lieu of vacuum pressure. The only key difference is that if positive pressure is used, the shaft does not need to rotate, and a traversing web will float above the surface of the porous media, resulting in the device acting as an air turn. In such an embodiment, there may be no contact with the web at all, resulting in mitigating issues related to the web being marked by the edges of the holes in a prior art roller. Also, as previously mentioned, this becomes a very cost-effective non-contact roll solution as the vacuum flow rate is relatively low, and the vacuum pressure can be higher than state-of-the-art technology. FIG. 2G shows a depiction of a series of non-contact air turns in a production line.

Figure 3A:
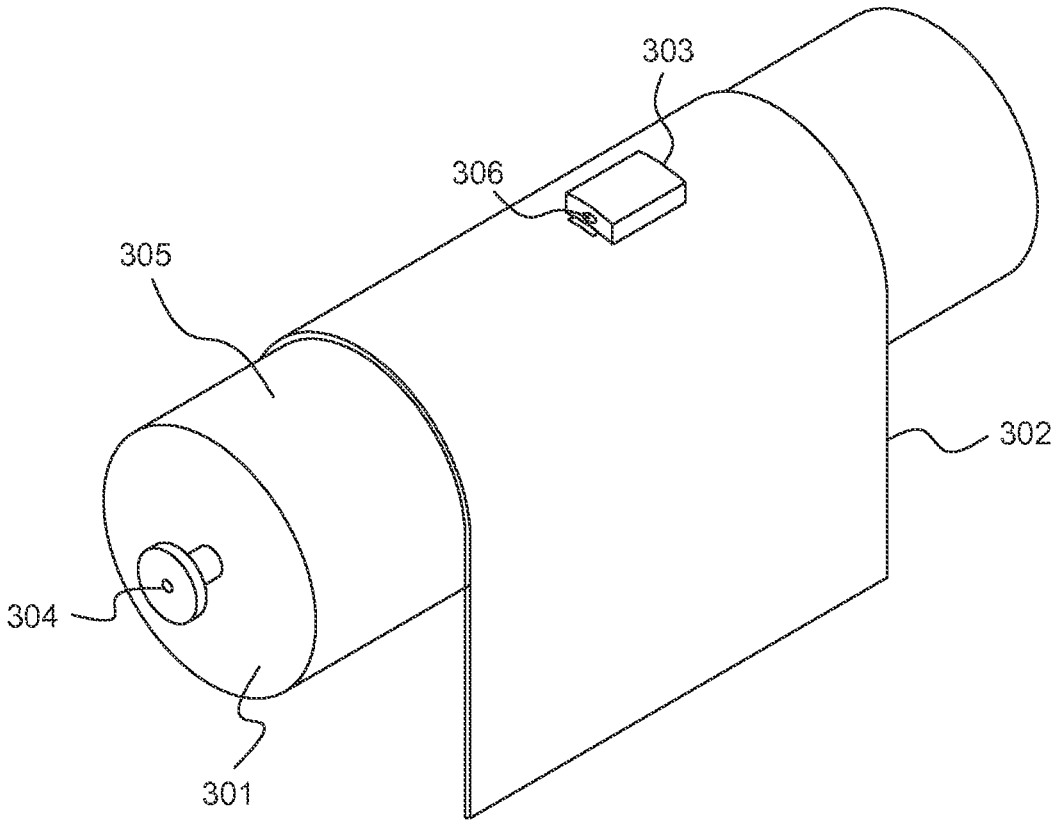
FIG. 3A shows an example of a porous media roller using porous media radial bearings to provide differential tension or act as an air turn.

FIG. 3A shows a shaft 301, which may be solid or hollow, covered with an outer porous media sleeve 305, and with pressure port 304. Also shown is a porous media radial gas bearing 303 with pressure port 306, similar to that sold by New Way Air Bearings. The radial gas bearing 303 is pressurized and used to provide force onto the web 302. Also, pressure is supplied into the porous media sleeve 305 via port 304. Hence, the pressure introduced into the porous sleeve 305 and the pressure introduced into the radial bearing 303 can both be adjusted to create the desired net force which acts downward on the web 302. Furthermore, this net force may cause the web to be in contact with the porous media roll, and may result in differential tension on the web. Multiple radial gas bearings may be used, as needed. The advantages of this method are immense—the web does not contact the radial bearing, yet a differential tension is generated. The flow rate is very low as compared to state-of-the-art vacuum roll methods. The simplicity of this method is vastly different than the complex state-of-the-art vacuum roll methods. Other embodiments of this method may include: a porous media roller that rotates, a porous media roller that is stationary, a porous media roller in which pressure is introduced into the porous media, and a porous media roller in which vacuum is drawn from the porous media.

Figure 3B:
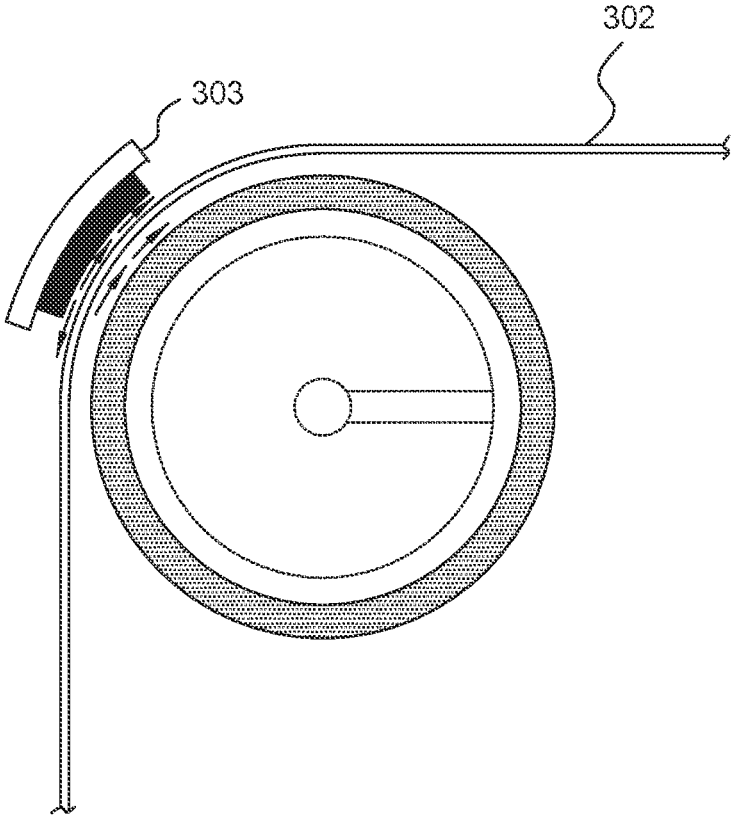
FIG. 3B shows an example of a porous media roller using a porous media radial bearing to act on a web and initiate a traversing motion.

FIG. 3B shows that when a pressurized radial bearing 303 is used in conjunction with a pressurized porous media roller, a bias in the orientation of the radial bearing 303 as shown may cause the web 302 to be driven to the right as a result of the input pressures and the orientation of the radial bearing 303. Even though the shaft is not rotating, the web is driven so that it traverses the shaft in a non-contact fashion. The small arrows on FIG. 3B indicate gas flow.

Figure 3C:
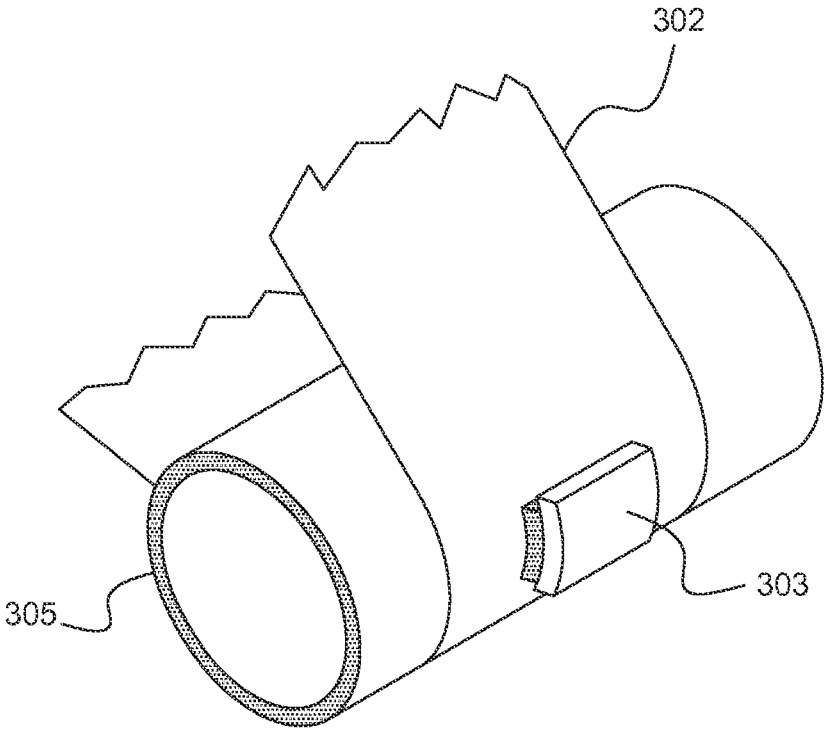
FIG. 3C shows an example of a porous media roller using a porous media radial bearing to provide lateral web motion.

FIG. 3C shows a similar phenomenon of a pressurized radial gas bearing 303 used in conjunction with a pressurized porous media roller to control the lateral movement or positioning of a web. By applying force and biasing the radial bearings as shown by the angular representation, the air film between the radial bearing and the web will have a wedge-type, graduated thickness, and this can be used to move the web laterally, in this case, to the right. A variety of biasing force and air wedge profile can be used to create a variety of lateral motions. By providing feedback between the position of the web (which can be sensed by instrumentation) and the biasing of the radial air bearings, this could result in automated adjustment of the lateral position of a web.

Figure 4:
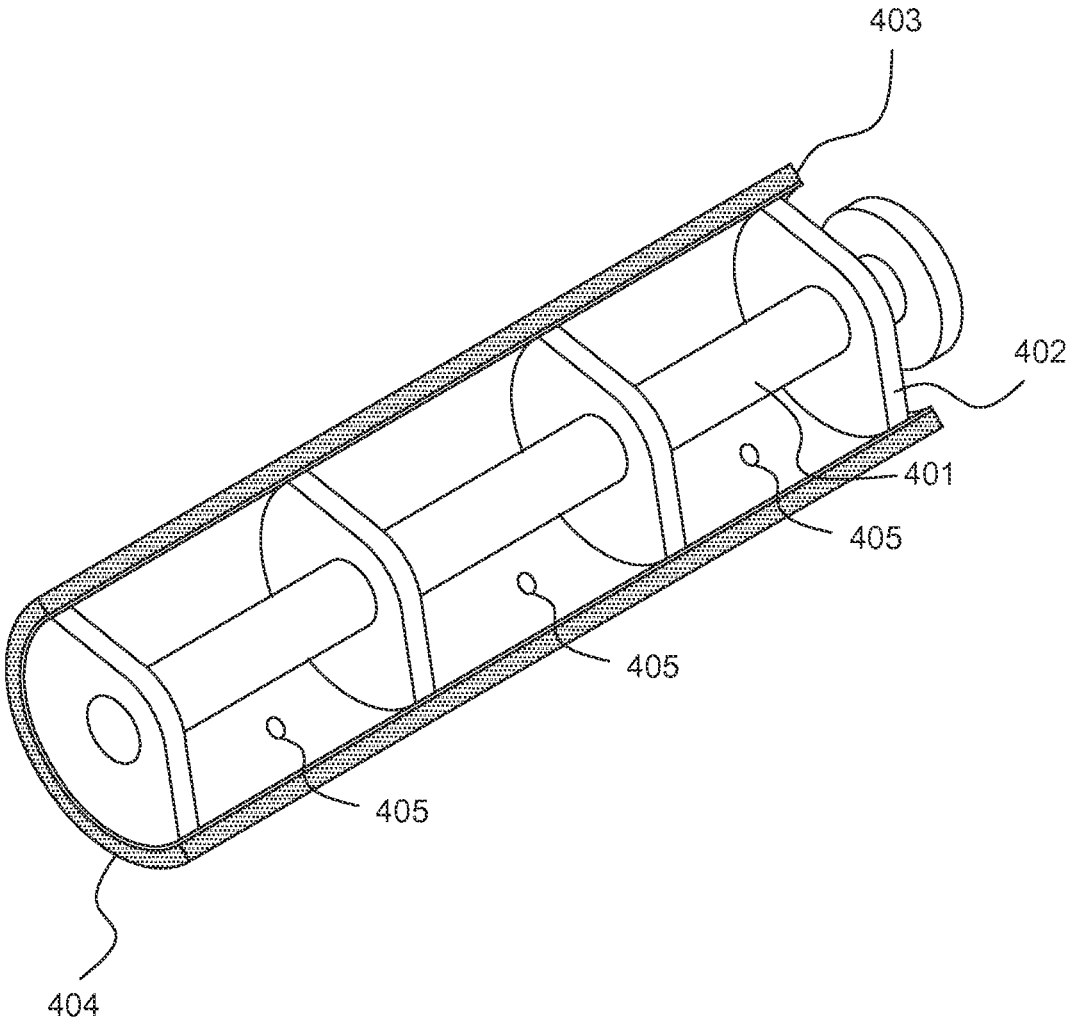
FIG. 4 shows an example of a partial arc porous media air turn.

FIG. 4 shows an example of an air turn utilizing carbon fiber materials, including a carbon fiber shaft 401, carbon fiber/foam supports 402, and a carbon fiber inner ring 403, which is glued onto an outer porous media sleeve 404. A series of grooves are installed into the inside diameter of the porous media outer ring to allow conductance of gas flow. Gas flow is introduced from the inside surface of the carbon fiber inner ring via ports 405, and flows through channels machined in the outer sleeve 404. The assembly is a partial wrap angle, but this construction could be used for a variety of wrap angles. The key benefits of this embodiment include the fact that a web does not contact the roller and the fact that it has significant weight advantages over state-of-the-art air turns. Weight savings are important in various web handling applications (such as when low mass components are needed for rapid acceleration).

In each of the above described embodiments, the vacuum (or positive pressure) may be employed by using any gas, such as air, nitrogen, or other. Also, the porous media may be comprised of any porous or sintered material such as graphite, carbon, silicon carbide, Tungsten carbide, porous diamond, alumina, carbon-carbon, a porous carbon base material with a diamond or diamond-like coating, and the like. The manufacture of porous media may employ ceramic casting techniques commonly known in the art, but may also employ other methods such as 3-D printing.

Figure 5:
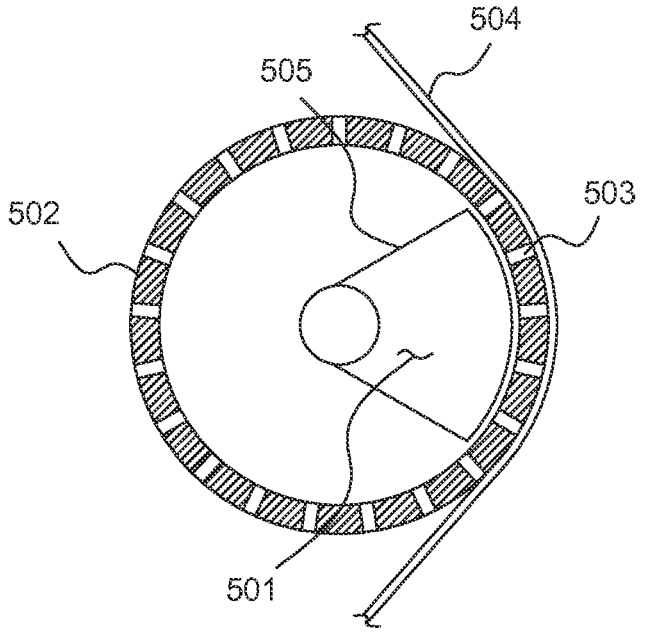
FIG. 5 shows a cross section view of a prior art vacuum roller.
Figure 6:
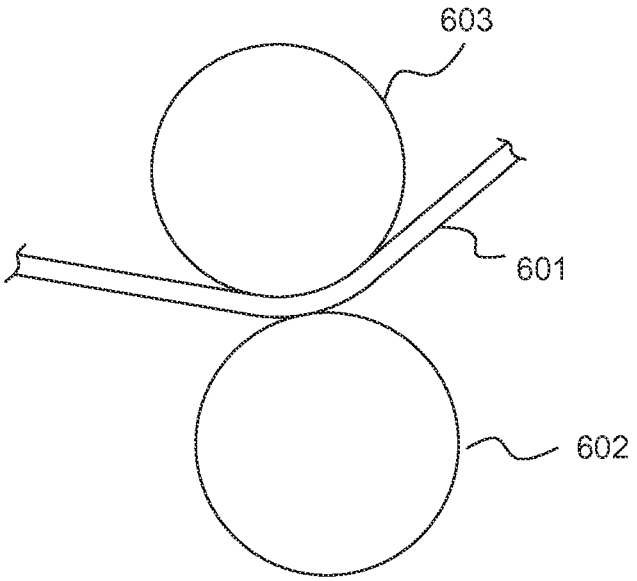
FIG. 6 shows a depiction of prior art pinch rollers.

FIGS. 5 and 6 show prior art configurations for a vacuum roller and pinch rollers, which are mentioned in the preceding paragraphs. In FIG. 5, a roll 502 contains an inner member 505, inside of which is an area of vacuum, introduced via a vacuum pump. The outside diameter of the inner member 505 and the inside diameter of the roll 502 are very tightly toleranced in order to prevent vacuum leakage. This adds to the cost of the prior art vacuum rolls. Also, the flow rate is very high in this arrangement, and the vacuum pressure which acts on the web 504 by means of being conducted through holes 503 in the roll 502, is low. The holes 503, which in reality are closer than shown, still present an issue with causing the web 504 to be marked by the holes 503. In FIG. 6, a traditional pinch roller is shown as being an alternative to producing differential tension. Each of the two rolls 602 and 602 rotate in a different direction and cause the web 601 to traverse, allowing for differential tension on either side of the rolls. However, the obvious detractor from this simple arrangement is the fact that the web 601 is contacted on both sides, with significant pressure (pinching) being applied to the roll.

While preferred embodiments have been set forth in detail with reference to the drawings, those skilled in the art who have reviewed the present disclosure will readily appreciate that other embodiments can be realized within the scope of the invention, which should therefore be construed as limited only by the appended claims.

What is claimed is:

1. A non-contact air turn, comprising:

a stationary porous media outer cylinder;

a stationary inner cylinder including at least one axial groove and a plurality of circumferential grooves in the outer surface configured to distribute externally pressurized gas to an inner surface of the stationary porous media outer cylinder, wherein the inside diameter of the outer cylinder substantially corresponds to the outer diameter of the inner cylinder; and a pair of end plates configured to support the inner and outer cylinders, wherein at least one end plate of the pair of end plates includes a port configured to provide the externally pressurized gas directly into the at least one axial groove in the outer surface.

2. The air turn of claim 1 further comprising glue configured to bond the stationary inner cylinder onto the outer porous media cylinder.

3. The air turn of claim 1 wherein the at least one of the stationary inner cylinder and the pair of end caps are formed using a carbon fiber material.

4. The non-contact air turn of claim 1 further comprising:

a radial gas bearing opposing the stationary porous media outer cylinder configured to apply a force against web stretched over the stationary porous media outer cylinder in order to create differential web tensions while still permitting a non-contact web condition.

5. A non-contact air turn, comprising:

a stationary porous media outer cylinder that includes at least one axial groove on the inner surface of the outer cylinder, the at least one axial groove configured to distribute an externally pressurized gas across the inner surface of the stationary porous media outer cylinder;

a stationary inner cylinder that includes at least one port configured to provide the externally pressurized gas to the at least one axial groove; and a pair of end plates configured to support the inner and outer cylinders.

6. The air turn of claim 5 further comprising glue configured to bond the stationary inner cylinder onto the outer porous media cylinder.

7. The air turn of claim 5 wherein the stationary inner cylinder has a series of circumferential grooves on the outer surface for gas conductance.

8. The air turn of claim 5 wherein the at least one of the stationary inner cylinder, and the pair of end plates are formed using a carbon fiber material.

9. The air turn of claim 5 further comprising:

a radial gas bearing opposing the stationary porous media outer cylinder configured to apply a force against a web stretched over the stationary porous media outer cylinder in order to create differential web tensions while still permitting a non-contact web condition.

10. A non-contact partial arc roller, comprising:

a stationary porous media outer partial arc that includes at least one axial groove on the inner surface of the partial arc, the at least one axial groove configured to distribute an externally pressurized gas across the inner surface of the stationary porous media outer partial arc;

a stationary inner partial arc that includes at least one port configured to provide the externally pressurized gas to the at least one axial groove; and a pair of end plates configured to support the inner and outer partial arcs.

11. The non-contact partial arc roller of claim 10 further comprising glue configured to bond the stationary inner partial arc onto the stationary porous media outer partial arc.

12. The non-contact partial arc roller of claim 10 wherein the stationary inner partial arc has a series of grooves on the outer surface for gas conductance.

13. The non-contact partial arc roller of claim 10 wherein the at least one of the stationary inner partial arc, and pair of end plates are formed using a carbon fiber material.

14. The non-contact partial arc roller of claim 10 further comprising: a radial gas bearing opposing the stationary porous media outer partial arc configured to apply a force against a web stretched over the stationary porous media outer partial arc in order to create differential web tensions while still permitting a non-contact web condition.

* * * * *